US009987668B2

(12) United States Patent
Kjellberg et al.

(10) Patent No.: US 9,987,668 B2
(45) Date of Patent: Jun. 5, 2018

(54) LIQUID EJECTION SYSTEM WITH NOZZLE HAVING TWO OUTLETS

(71) Applicant: ALFA LAVAL CORPORATE AB, Lund (SE)

(72) Inventors: Kim Kjellberg, Herlev (DK); Leon Hjorslev, Greve (DK)

(73) Assignee: ALFA LAVAL CORPORATE AB, Lund (SE)

( * ) Notice: Subject to any disclaimer, the term of this patent is extended or adjusted under 35 U.S.C. 154(b) by 0 days. days.

(21) Appl. No.: 14/440,920

(22) PCT Filed: Jun. 4, 2013

(86) PCT No.: PCT/EP2013/061464
§ 371 (c)(1),
(2) Date: May 6, 2015

(87) PCT Pub. No.: WO2014/072087
PCT Pub. Date: May 15, 2014

(65) Prior Publication Data

US 2015/0298182 A1 Oct. 22, 2015

(30) Foreign Application Priority Data

Nov. 8, 2012 (EP) ..... 12191805

(51) Int. Cl.
*B08B 9/093* (2006.01)
*B05B 3/04* (2006.01)
(Continued)

(52) U.S. Cl.
CPC ..... *B08B 9/0936* (2013.01); *B01F 5/0206* (2013.01); *B05B 1/14* (2013.01);
(Continued)

(58) Field of Classification Search
CPC ..... B05B 3/0445; B08B 9/0936; B08B 9/08; B08B 9/0813
(Continued)

(56) References Cited

U.S. PATENT DOCUMENTS 4,715,538 A 12/1987 Lingnau
4,986,476 A 1/1991 Hour
(Continued)

FOREIGN PATENT DOCUMENTS

BE 525 630 A 11/1954
CN 2267102 A 11/1997
(Continued)

OTHER PUBLICATIONS

*International Search Report (PCT/ISA/210) dated Jul. 25, 2013, by the European Patent Office as the International Searching Authority for International Application No. PCT/EP2013/061464.
(Continued)

*Primary Examiner* — Alexander Valvis
(74) *Attorney, Agent, or Firm* — Buchanan Ingersoll & Rooney PC

(57) ABSTRACT

A liquid ejection apparatus comprising a fluid line configured to extend into a tank and to receive a liquid, a rotary head being arranged on the pipe and fitted with a rotary hub that comprises a liquid ejection nozzle for ejecting the liquid, the rotary head being rotatable in a first direction and the rotary hub being rotatable in a second direction, such that the liquid ejected by the nozzle is ejected in a pattern on an interior surface of the tank. The liquid ejection nozzle comprises a first liquid outlet capable of ejecting the liquid in a first direction towards the interior surface of the tank, and a second liquid outlet capable of ejecting the liquid in a second direction towards the interior surface of the tank.

21 Claims, 6 Drawing Sheets

(51) Int. Cl.

| | |
|---|---|
| ***B05B 1/14*** | (2006.01) |
| ***B05B 3/06*** | (2006.01) |
| ***B05B 13/06*** | (2006.01) |
| ***B01F 5/02*** | (2006.01) |
| ***B05B 3/10*** | (2006.01) |

(52) U.S. Cl.
CPC ..... *B05B 3/0445* (2013.01); *B05B 3/06* (2013.01); *B05B 3/1007* (2013.01); *B05B 13/0636* (2013.01)

(58) Field of Classification Search
USPC ..... 134/166 R, 167 R, 167 C, 168 R, 168 C; 239/227, 240, DIG. 13
See application file for complete search history.

(56) References Cited

U.S. PATENT DOCUMENTS

| | | | | |
|---|---|---|---|---|
| 5,169,069 | A * | 12/1992 | Rucker | B08B 9/0936 239/227 |
| 6,460,553 | B1 | 10/2002 | Owens et al. | |
| 7,318,555 | B1 | 1/2008 | Ueda et al. | |
| 8,177,917 | B2 | 5/2012 | Lindros | |
| 8,911,564 | B2 * | 12/2014 | Hatten | B08B 9/0813 134/168 R |
| 2002/0144714 | A1 * | 10/2002 | McCasker | B08B 9/0936 134/22.18 |
| 2004/0238009 | A1 * | 12/2004 | Falster-Hansen | B08B 9/08 134/22.1 |
| 2006/0243307 | A1 * | 11/2006 | Jinback | B08B 9/0936 134/22.1 |
| 2008/0142042 | A1 | 6/2008 | Bramsen | |
| 2011/0079254 | A1 * | 4/2011 | Delaney | B05B 3/0445 134/198 |
| 2012/0017951 | A1 * | 1/2012 | Ross | B08B 9/0936 134/168 R |
| 2012/0060872 | A1 | 3/2012 | Ross | |

FOREIGN PATENT DOCUMENTS

| | | | |
|---|---|---|---|
| CN | 2341727 | | 10/1999 |
| CN | 1482942 | A | 3/2004 |
| DE | 1 237 969 | B | 4/1967 |
| DE | 198 11 421 | A1 | 9/1999 |
| DE | 201 13 587 | U1 | 2/2002 |
| GB | 186735 | | 7/1921 |
| GB | 204970 | | 12/1922 |
| GB | 2 315 106 | A | 1/1998 |
| JP | 63-252563 | A | 10/1988 |
| JP | 63-294498 | A | 12/1988 |
| JP | 08-080479 | A | 3/1996 |
| JP | 09-174006 | A | 7/1997 |
| JP | 2005-81221 | A | 3/2005 |
| WO | WO 92/04994 | A1 | 4/1992 |
| WO | WO 2010/117324 | A1 | 10/2010 |
| WO | WO 2010/144035 | A1 | 12/2010 |

OTHER PUBLICATIONS

Written Opinion (PCT/ISA/237) dated Jul. 25, 2013, by the European Patent Office as the International Searching Authority for International Application No. PCT/EP2013/061464.
Chinese Office Action dated Aug. 1, 2016, by the Chinese Patent Office, in corresponding Chinese Patent Application No. 201380058180.2 (11 pages).

* cited by examiner

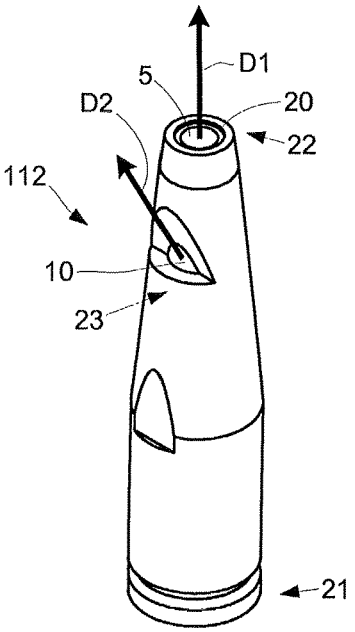
Fig. 5
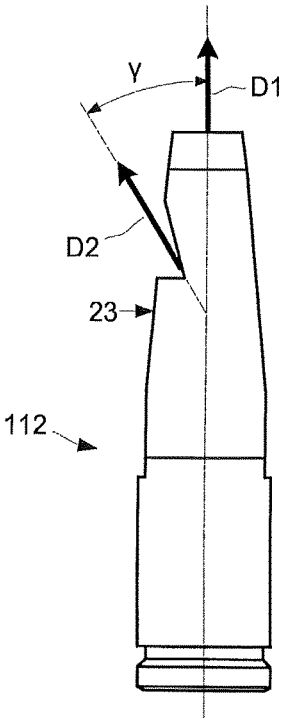
Fig. 6
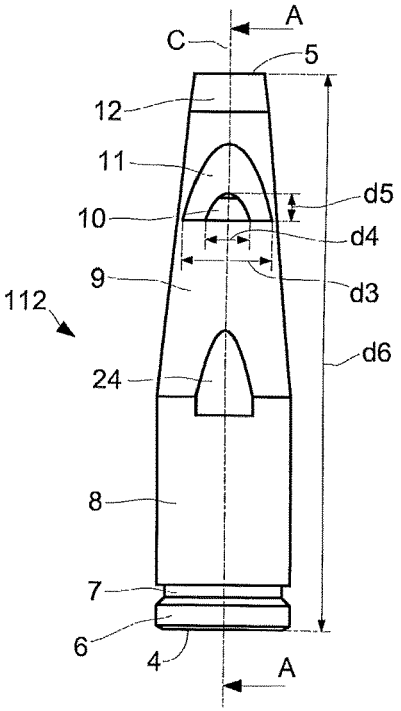
Fig. 7
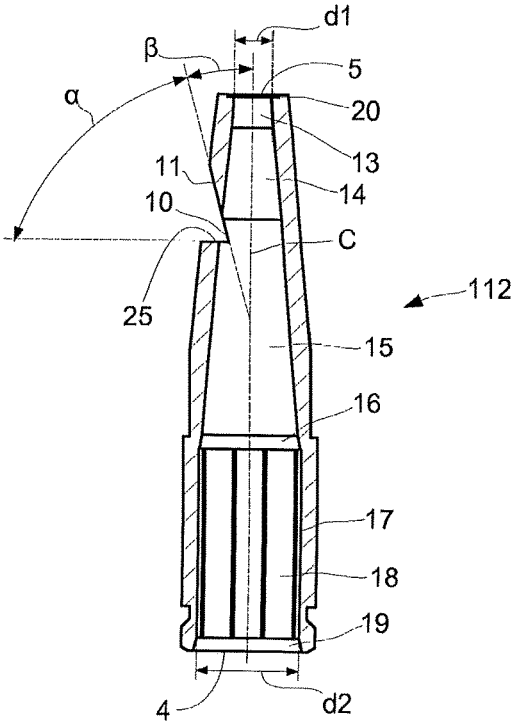
Fig. 8 (A-A)

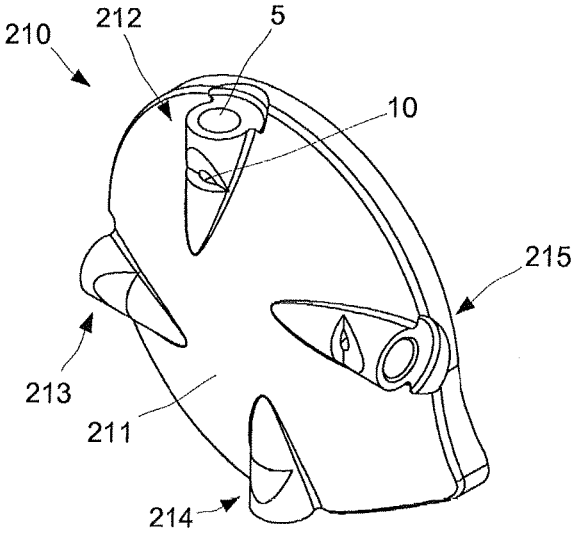
Fig. 13
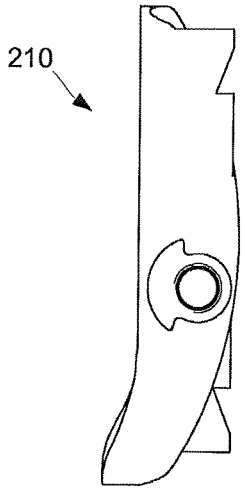
Fig. 14
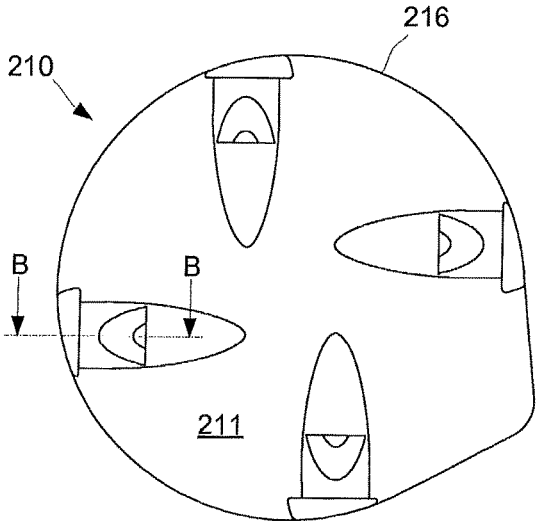
Fig. 15
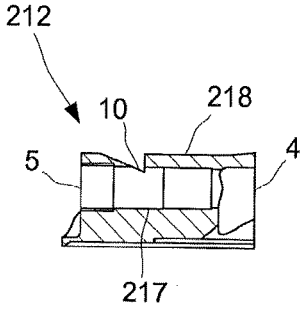
Fig. 16 (B-B)

LIQUID EJECTION SYSTEM WITH NOZZLE HAVING TWO OUTLETS

TECHNICAL FIELD

The invention relates to systems for internal cleaning of tanks and/or for mixing of contents in tanks, and in particular to liquid ejection nozzles for reducing time and resources required for achieving proper cleaning and/or mixing.

BACKGROUND ART

Liquid containment tanks or containers are used in a number of industrial processes such as food manufacturing, pharmaceutical manufacturing, chemical processing, material fermentation and so on. It is often critical to ensure that the interior of the tank is free of unwanted debris and contaminants. For example, a tank that is typically filled to a certain level may exhibit a "tub ring" about its interior circumference at the level to which the tank is most often filled. Also, various equipment within a tank, tank inlets and outlets etc. may trap sediment or debris that may later reenter the tank contents during use.

Unwanted contaminants in the tank may negatively impact the quality of the finished product being manufactured or processed. Also, the interior of a tank must be properly cleaned if regulations relevant to certain industries such as pharmaceutical processing shall be followed. Thus, it is common to clean the interior of such tanks at certain intervals, e.g. after each process batch, to ensure product quality and adherence to any relevant regulations.

Tank cleaning systems are available that clean debris and residue from the interior of tanks and other vessels through the use of what is commonly known as impingement cleaning. One common type of such systems employs a cleaning apparatus that is inserted into the tank and which has a hose or pipe that extends into the tank. At an innermost end of the pipe a rotary jet head is affixed. The rotary jet head is rotatable about one or two axes and, in the latter case, is typically geared such that as the jet head rotates about an axis of the pipe, it also turns upon an axis perpendicular to the pipe.

A relationship between rotations about two axes depends on a gearing ratio, which is selected such that a combination of a particular orientation and position of the jet head repeats only after multiple revolutions around the axis of the pipe. This technique staggers subsequent traces of the spray against a tank interior on each revolution of the rotary head to ensure that substantially every portion of the tank interior is exposed to the cleaning spray at some time during the cleaning process. The accomplished traces of the spray against the tank provides a cleaning apparatus that sprays cleaning liquid in a predetermined pattern on the interior surface of the tank.

To ensure that the interior of a tank is adequately cleaned the cleaning liquid should be sprayed in the predetermined pattern. Alternatively, a cleaning duration may be prolonged, which however may lead to excessive waste of time, cleaning fluid, and energy.

To ensure adequate cleaning while still avoiding excessive waste some different techniques have been employed. For example, patent document US 2008/0142042 A1 discloses a tank cleaning system that allows for a cleaning process to be monitored and provides a cleaning validation. This is done by automatically accounting for characteristics of a tank being cleaned and by modifying the cleaning operation accordingly. Patent document WO2010/117324 A1, on the other hand, discloses how cleaning is improved by a liquid ejection nozzle that regularly sprays the pipe that extends into the tank.

The cleaning apparatus may also be used for mixing a content of the tank. This is typically done by filling the tank with the content until the rotary jet head is fully underneath a surface of the content. The content is then mixed by circulating it from an outlet of the tank and back into the tank via the rotary jet head. As with cleaning, mixing must be adequately performed and it is important that this may be done without e.g. excessive circulation of content. When a tank cleaning apparatus is capable of also performing mixing of a content of the tank, the apparatus is often referred to as a liquid ejection apparatus.

Present techniques ensure in some cases that cleaning of the interior of tanks and/or mixing of a content of a tank is accomplished while still ensuring that cleaning or mixing time and use of cleaning resources like various detergents are kept at a low level. However, there may be problems in some cases, for example because of the size and shape of the tank, the type of substance to be cleaned of from the tank interior or mixed in the tank, varying climate conditions in the environment surrounding the tank, irregular or deficient behavior of components cooperating with the liquid ejection apparatus etc. Thus, it is estimated that improvements may be made in respect of reducing time and resources required for obtaining proper cleaning and/or mixing.

SUMMARY

It is an object of the invention to improve the above techniques and the prior art. In particular, it is an object to provide a liquid ejection system that may reduce time and resources required for obtaining proper cleaning of a tank and/or mixing of a tank content.

To solve these objects a liquid ejection apparatus is provided. The liquid ejection apparatus comprises a fluid line that is configured to extend into a tank and to receive a liquid, and a rotary head that is arranged on the fluid line and fitted with a rotary hub that comprises a liquid ejection nozzle for ejecting the liquid. The rotary head is rotatable in a first direction about a first geometrical axis and the rotary hub is rotatable in a second direction about a second geometrical axis that is offset from the first geometrical axis, such that the liquid ejected by the nozzle is ejected in a pattern towards an interior surface of the tank. The liquid ejection nozzle comprises a first liquid outlet that is capable of ejecting the liquid in a first direction towards the interior surface of the tank, and comprises a second liquid outlet that is capable of ejecting the liquid in a second direction towards the interior surface of the tank.

The apparatus is advantageous in that the two liquid outlets of the liquid ejection nozzle provide efficient cleaning of the interior of the tank. The efficient cleaning comes from a more advanced liquid ejection pattern that is obtained by the two outlets. The outlets also accomplish efficient mixing of a content of the tank. As will be described further on, some measurements of the nozzle and its outlets have been optimized for obtaining a desirable cleaning result as well as a desirable mixing result in the event that the apparatus also is used for mixing. When the nozzle has been optimized, other operation parameters of the liquid ejection apparatus have also been taken into account.

The second axis may be offset from the first axis by an angle of 80° to 100°. The first direction for the liquid from the first opening may be offset, by an angle of 5° to 60°, from the second direction for the liquid from the second opening.

The liquid ejection nozzle may have an elongated shape and may protrude from the rotary hub.

A liquid inlet may be arranged at a first end of the liquid ejection nozzle while the first liquid outlet is arranged at a second end of the liquid ejection nozzle, where the second end is opposite the first end. The second liquid outlet may then be arranged at a side of the liquid ejection nozzle.

The liquid ejection nozzle may form a unitary body were the second liquid outlet has the form of an opening in the side of the liquid ejection nozzle.

The second liquid outlet may comprise a surface that is inclined by an angle of 5° to 45° in relation to a center axis of the liquid ejection nozzle, for directing liquid that is ejected from the second liquid outlet.

The second liquid outlet may be configured to eject the liquid in form of a spray beam.

The second liquid outlet may be configured to ejected liquid from the second liquid outlet such that the liquid diverges by an angle of 20° to 90°, as seen in a first geometrical plane that is parallel to a center axis of the nozzle.

The second liquid outlet may be configured to ejected liquid from the second liquid outlet such that the liquid ejected from the second liquid outlet diverges by an angle of 0° to 50°, as seen in a second geometrical plane that is parallel to a center axis of the nozzle and perpendicular to the first geometrical plane.

The second liquid outlet may be arranged on a side of the liquid ejection nozzle that faces the fluid line during a period of time when the rotary hub rotates in the second direction about the second geometrical axis.

In one embodiment the liquid ejection nozzle is a first liquid ejection nozzle, and the liquid ejection apparatus comprising a second liquid ejection nozzle that is arranged on the rotary hub. The second liquid ejection nozzle comprises a first liquid outlet capable of ejecting the liquid in a third direction towards the interior surface of the tank, and a second liquid outlet capable of ejecting the liquid in a fourth direction towards the interior surface of the tank. The second outlet of the second liquid ejection nozzle may then be arranged on a side of the second liquid ejection nozzle that faces another direction than the second liquid outlet of the first liquid ejection nozzle.

The second liquid outlet may have a width of at least 3 mm.

The liquid ejection apparatus may comprise a pump that feeds the fluid into the liquid ejection nozzle at a pressure of 1 to 9 bar and at a flow rate of 10 to 250 liters per minute.

The liquid ejection apparatus may comprise a drive system that provides a rotation of the rotary head in the first direction at a rotational speed of 0.2 to 6 revolutions per minute (rpm), and a rotation of the rotary hub in the second direction at a rotational speed of 0.2 to 10 rpm.

Still other objectives, features, aspects and advantages of the invention will appear from the following detailed description, from the attached claims as well as from the drawings.

BRIEF DESCRIPTION OF THE DRAWINGS

Embodiments of the invention will now be described, by way of example, with reference to the accompanying schematic drawings, in which FIG. 5 is a perspective view of a fluid ejection nozzle of the liquid ejection apparatus of FIG. 1, FIG. 6 is a side view of the fluid ejection nozzle of FIG. 5, FIG. 7 is a front view of the fluid ejection nozzle of FIG. 5, FIG. 8 is a cross sectional view of the fluid ejection nozzle of FIG. 5, as seen along line A-A in FIG. 7, FIG. 13 is a perspective view of a rotary hub of the liquid ejection apparatus of FIG. 12, FIG. 14 is a side view of the rotary hub of FIG. 12, FIG. 15 is a front view of the rotary hub of FIG. 12, and FIG. 16 is a cross-sectional view of a nozzle of the rotary hub of FIG. 12, as seen along line B-B in FIG. 15.

DETAILED DESCRIPTION

Figure 1:
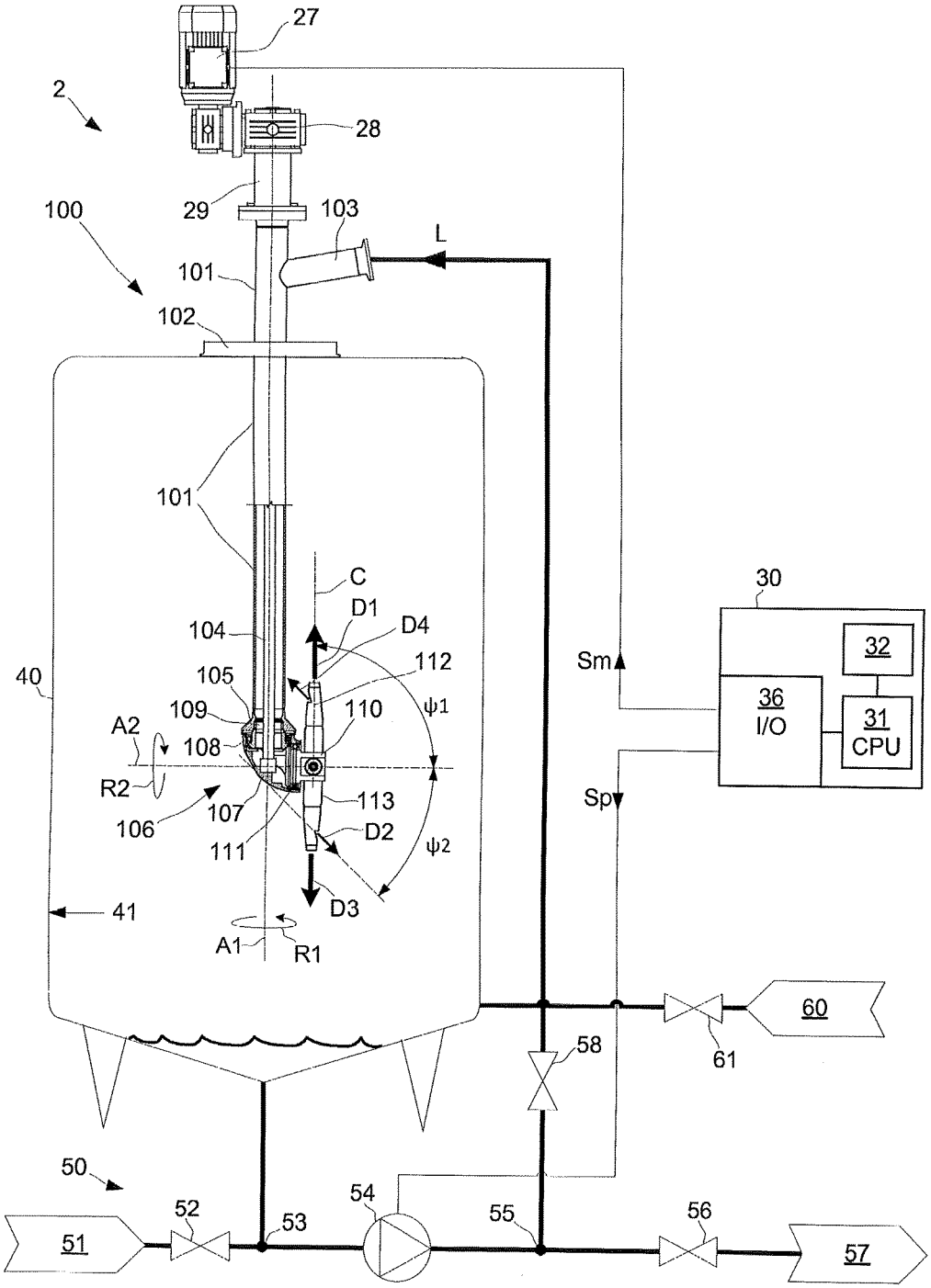
FIG. 1 is a schematic view of a liquid ejection system that includes a liquid ejection apparatus for cleaning an interior surface of a tank and/or for mixing a content of a tank.

With reference to FIG. 1 an embodiment of a liquid ejection system 2 that is configured to eject a liquid L in a tank 40 is illustrated. The system 2 comprises a liquid ejection apparatus 100, a drive unit 27 for the liquid ejection apparatus 100, and a processing unit 30 that is configured to control the drive unit 27 and thereby a pattern for how liquid L is ejected from the liquid ejection apparatus 100 and into the tank 40.

The liquid ejection apparatus 100 has a fluid line in form of a pipe 101 that extends into the tank 40 via an opening in an upper part of the tank 40. The fluid line may be e.g. a hose instead of pipe. The liquid ejection apparatus 100 has a flange 102 that provides a secure connection as well as a tight seal to the tank 40. An upper part of the pipe 101 that is outside the tank 40 has an inlet 103 for receiving the liquid L. A lower part of the pipe 101 that extends into the tank 40 has at its end a connection flange 105 to which a rotary head 106 is connected.

The rotary head 106 comprises a housing 107 that is rotatable around a first axis A1 that is parallel to the pipe 101. A first bearing 108 is arranged in between the connection flange 105 and an inlet end of the housing 107 that faces the connection flange 105, such that the housing 107 may rotate relatively the connection flange 105.

The rotary head 106 also comprises a rotary hub 110 on which a number of liquid ejection nozzles 112, 113 are arranged. In the illustrated embodiment four nozzles are symmetrically arranged on the rotary hub 110 even though it is possible to have e.g. only one nozzle on the rotary hub 110. It is also possible to have two, three or more than four liquid ejection nozzles on the rotary hub 110. If more than one liquid ejection nozzle is arranged on the rotary hub 110 these nozzles may be identical or different.

A second bearing 111 is arranged in between the rotary hub 110 and an outlet end of the housing 107 that faces the rotary hub 110, such that the rotary hub 110 may rotate relatively the housing 107. The second bearing 111 allows the rotary hub 110 to rotate about a second axis A2 that is typically offset from the first axis A1 by an angle of 80-100°

(90° in the illustrated embodiment). Thus, the rotary hub 110 and the nozzles 112, 113 are able to rotate in a first direction R1 about the first axis A1 and in a second direction R2 about the second axis A2, as seen relative the pipe 101 or relative the tank 40.

The inlet 103 and the pipe 101 each have the principal shape of a conventional pipe and are capable of transporting liquid L to be ejected into the tank 40. Liquid L enters the inlet 103, is conveyed into the pipe 101 and towards the rotary head 106. Liquid L then enters the rotary head 106 at the housings 107 connection to the connection flange 105 and exits the housing 107 at the housings 107 connection to the rotary hub 110. The rotary hub 110 receives liquid from the housing 107 and distributes liquid L further to the nozzles 112, 113, which eject the liquid L into the tank 40 such that liquid L hits (impinges on) an interior surface 41 of the tank 40 (when cleaning is performed), alternatively eject the liquid L into the tank 40 such that liquid L is streamed into a content of the tank, towards the interior surface 41 of the tank 40 (when mixing is performed).

The rotation in the first direction R1 about the first axis A1 is accomplished via a shaft 104 that extends from an upper end of the pipe 101 and to the rotary head 106 where it is connected to the housing 107. The shaft 104 has a diameter that is smaller than both an inner diameter of the pipe 101, an inner diameter of the connection flange 105 and a diameter of an opening at the inlet end of the housing 107. This allows liquid L to flow past the shaft 104. When the shaft 104 is rotated, the housing 107 and thereby the rotary head 106 are rotated in the first direction R1.

The pipe 101 is connected to a connection piece 29 and a gearbox 28 is connected to the connection piece 29. The shaft 104 is connected to the gearbox 28, which in turn is connected to the drive unit 27. The drive unit 27 is here a conventional electrical motor 27, but other types of motors such as a pneumatic motor may be used just as well. When the motor 27 is activated, it generates a rotation of the shaft 104 and thereby a rotation of the rotary head 106 in the first direction R1. Alternatively, the drive unit 27 may be embodied as an impeller that is arranged in a flow path of the liquid L, e.g. after the inlet 103, where a rotation of the impeller drives the gearbox 28 and thus effects the rotation of the rotary head 106 in the first direction R1.

To accomplish the rotation in the second direction R2 a drive member 109 in form of an impeller 109 is arranged inside the housing 107. The motor 27 and the impeller 109 form a drive system 27, 109 that provides the rotations in the first R1 and in the second R2 directions. A rotation of the impeller 109 is induced by a flow of liquid L that passes through the housing 107, from the inlet end to the outlet end of the housing 107. When the impeller 109 rotates, its rotational movement is used for generating a rotation of the rotary head 106, or more specifically, for generating a rotation of the rotary hub 110 in the second direction R2. Any suitable technique for arranging the impeller 109 and for transferring a rotational movement of the impeller 109 to the rotary hub 110 may be employed.

Alternatively, an impeller as described in patent document WO92/04994 may be used for accomplishing the rotations in the first R1 and in the second R2 directions.

A liquid circuit 50 is connected to the tank 40 and to the liquid ejection apparatus 100 for accomplishing a flow of liquid L that shall be ejected from the nozzles 112, 113 and into the tank 40. The liquid circuit 50 comprises, in a downstream direction, a liquid source 51, a first valve 52, a first connection point 53, a pump 54, a second connection point 55 and a second valve 58. After the second valve 58 the liquid circuit 50 is connected to the inlet 103 of the liquid ejection apparatus 100. A bottom of the tank 40 is connected to the liquid circuit 50 at the first connection point 53. A liquid outlet 57 is via a third valve 56 connected to the second connection point 55. A second source of liquid 60 is via a fourth valve 61 connected to the tank 40.

The pump 54 may be e.g. a gear pump, a lube pump, a centrifugal pump or a pump of another suitable type. The valves 52, 56, 58, 61 may be butterfly valves, globe valves or valves of another suitable type. A liquid from the liquid source 51 is typically a liquid to be mixed or processed in the tank 40 or a liquid that constitutes a major part of a liquid to be mixed or processed in the tank 40. A liquid content of the second source of liquid 60 may be a liquid to be mixed with the liquid from the liquid source 51, or may be a liquid to be used for cleaning of the tank 40. Additional liquid sources may be connected to the tank 40, as required by a predetermined mixing or cleaning application.

By opening the first valve 52 and by closing the second valve 58 and the third valve 56 (or having the pump 54 inactive, depending on pump type), liquid may be fed from the liquid source 51 and into the tank 40 via the first connection point 53. In this way the tank 40 may be filled with a liquid content. When the system 2 shall perform mixing, the tank 40 is typically filled to such an extent that a liquid content in the tank 40 completely covers the rotary head 106 and all the nozzles 112, 113. Thus, a surface of the liquid content is then well above the rotary head 106 and the nozzles 112, 113.

By closing the first valve 52 and the third valve 56, opening the second valve 58 and operating the pump 54, the liquid content of the tank 40 may be circulated via the liquid circuit 50 and the liquid ejection apparatus 100. This circulation effects mixing of a liquid content since liquid L then is ejected into the liquid content, which efficiently causes the liquid content to be stirred.

By closing the first valve 52 and the second valve 58, opening the third valve 56 and operating the pump 54, liquid content may be expelled from the tank 40 by transporting it to the liquid outlet 57. In this context, when liquid content is expelled, some content is typically still present in the tank 40, i.e. expelling a liquid content does not necessarily mean that every part of the liquid content in the tank 40 is completely removed from the tank 40. Content that is present in the tank 40 after the expelling is typically cleaned of in a cleaning process performed by the liquid ejection apparatus 100.

The liquid content of the second source of liquid 60 may be introduced in the tank 40 by opening the fourth valve 61. If this is done during a mixing operation the liquid content of the second source of liquid 60 is efficiently mixed into the content of the tank 10.

When the system 2 shall effect cleaning of the tank 40 the liquid content of the second source of liquid 60 may be a cleaning liquid. Then the cleaning liquid is introduced into the tank 40 after the (mixed) liquid content is expelled. Cleaning is then effected by closing the first valve 52 and the third valve 56, by opening the second valve 58 and by operating the pump 54. The liquid L is then a cleaning liquid that is expelled into the tank 40 and hits the inner surface 41, which efficiently effects cleaning of the inner surface 41. Generally, when cleaning is effected the cleaning liquid in the tank 40 does not cover the rotary head 106, i.e. the rotary head 106 and the nozzles 112, 113 are then not submersed in a liquid content. Instead, the liquid is ejected in a predetermined pattern on the interior surface 41 of the tank 40.

To control the system 2 the processing unit 30 has a central processing unit 31 (CPU) that is connected to and controls an electronic input/output interface 36 (I/O). The I/O interface 36 is in turn electrically connected to the motor 27 and to the pump 54 to provide control signals Sm and Sp. The CPU 31 is a central processing unit or microprocessor of a conventional type and represents the portion of the processing unit 30 that is capable of carrying out instructions of a computer program which is stored in a memory unit 32 of the processing unit 30. The CPU 31 is the primary element carrying out the functions of the processing unit 30.

Figure 2:
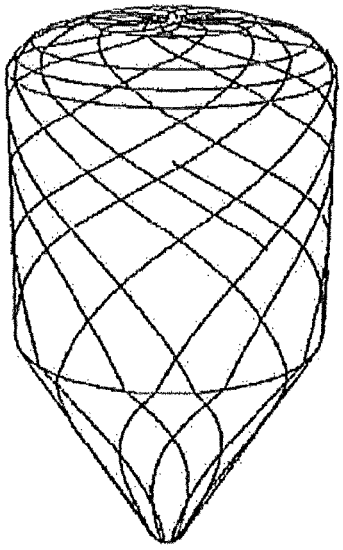
FIGS. 2-4 illustrate a principal predetermined pattern of ejected liquid as generated by the liquid ejection system in FIG. 1 at three consecutive time points.
Figure 3:
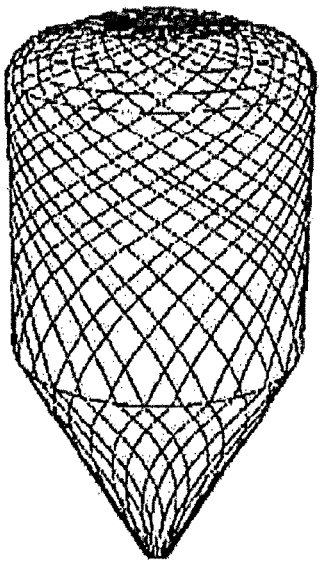
Figure 4:
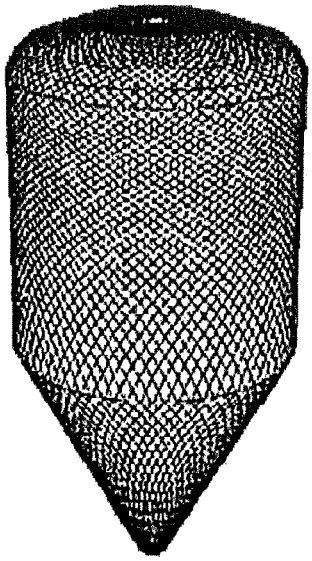

When liquid is ejected from the nozzles 112, 113 for cleaning the interior surface 41, the rotary hub 110 rotates in the first and second directions R1, R2. Then the liquid is ejected as spray beams and/or jet beams in a predetermined pattern on the interior surface 41. FIGS. 2-4 illustrate an example of such a predetermined pattern, where the coarse pattern in FIG. 2 may be achieved after e.g. 1 minute, the denser pattern in FIG. 3 after 2.5 minutes, and a so-called full pattern as in FIG. 4 after 7 minutes. When the system 2 performs mixing the rotary hub 110 rotates in the same first and second directions R1, R2. However, then the liquid generally does not impinge on the interior surface 41, but is instead injected directly into a content of the tank. Still, the direction of the injection follows the same pattern as shown in FIGS. 2-4. The pattern illustrated in FIGS. 2-4 is a pattern that is obtained when the nozzles 112, 113 have two respective liquid outlets. If the nozzles had only one respective liquid outlet then the patterns in FIGS. 2-4 would have been half as dense.

With further reference to FIGS. 5-8, the liquid ejection nozzles 112, 113 have two liquid outlets which will, over a same period of time, give a denser predetermined pattern on the interior surface 41 in comparison with nozzles that have only one liquid outlet. Specifically, the liquid ejection nozzle 112 has a first liquid outlet 5 that ejects the liquid L in a first direction D1 towards the interior surface 41 of the tank 40, and it has a second liquid outlet 10 that ejects the liquid L in a second direction D2 towards the interior surface 41 of the tank 40. The direction D1 may be seen as the arithmetic average (or weighted average) of the direction of liquid that is ejected from the first liquid outlet 5. D1 is typically parallel to a center axis C of the liquid ejection nozzle 112. The direction D2, may, in a corresponding manner, be seen as the arithmetic average (or weighted average) of the direction of liquid that is ejected from the second liquid outlet 10. D2 may then have one component that is parallel to the center axis C (compare FIG. 10) and one component that is inclined from the center axis C by an angle of $\gamma°$, or by $(\beta+\theta 2/2)°$ (compare FIG. 9). Thus, the first liquid outlet 5 and the second liquid outlet 10 are configured such that the second direction D2 is offset from the first direction D1 by an angle $\gamma$ of 5° to 60°.

The second direction D2 is inclined to the second geometrical axis A2 by an angle $\psi 2$ of 10°-80°. In one embodiment the second direction D2 is inclined to the second geometrical axis A2 by an angle $\psi 2$ of 30°-60°. The first direction D1 is inclined to the second geometrical axis A2 by an angle $\psi 1$ of 80°-100°. In the illustrated embodiment the angle $\psi 1$ is 90°. The second direction D2 is directed away from the first geometrical axis A1 at all times during a rotation of the rotary hub 110 about the second geometrical axis A2. From the figure it is clear that the second direction D2 is inclined to the first geometrical axis A1 at all times during a rotation of the rotary hub 110 about the second geometrical axis A2.

The first liquid outlet 5 has such a shape and size that it ejects the liquid L in form of a jet beam. The second liquid outlet 10 has such a shape that is ejects the liquid L in form of a spray beam. To accomplish this the first liquid outlet 5 typically has a larger cross-sectional area than a cross-sectional area of the second liquid outlet 10, and/or the first liquid outlet 5 may have a circular shape while the second liquid outlet 10 has an elongated shape, i.e. the second liquid outlet 10 may have a shape where one side is longer than another side. In another embodiment the second liquid outlet 10 ejects liquid in form of a jet, in which case the second liquid outlet 10 may have a circular shape.

The second liquid outlet 10 comprises a surface 11 that is inclined by an angle $\beta$ of 5° to 60° in relation to the center axis C of the liquid ejection nozzle 112, for directing liquid that is ejected from the second liquid outlet 10. The second liquid outlet 10 comprises a further surface 25 that is inclined by an angle $\alpha$ of 10° to 90° in relation to the surface 11. Thus, the further surface 25 is inclined by an angle of $\alpha+\beta$ in relation to the center axis C.

The liquid ejection nozzle 112 has an elongated shape and protrudes from the rotary hub 110, along a direction that may be transverse to the second geometrical axis A2. In general, this may mean that the liquid ejection nozzle 112 protrudes in a direction that is, during a period of the rotation of the rotary hub 110 around the second axis A2, parallel to a direction along which the pipe 101 extends.

Apart from the second liquid outlet 10 the liquid ejection nozzle 112 is substantially symmetrical about the center axis C. The external shape of the liquid ejection nozzle 112 is cylindrical with a tapered end near the first liquid outlet 5. As may be seen in FIG. 8, the liquid ejection nozzle 112 is hollow such that liquid may flow through the liquid ejection nozzle 112 from a liquid inlet 4 of the liquid ejection nozzle 112, to the first liquid outlet 5 and to the second liquid outlet 10.

The liquid inlet 4 is arranged at a first end 21 of the liquid ejection nozzle liquid ejection nozzle 112. The first liquid outlet 5 is arranged at a second end 22 of the liquid ejection nozzle 112, where the second end 22 is opposite the first end 21. The second liquid outlet 10 is arranged at a side 23 of the liquid ejection nozzle 112, i.e. the second liquid outlet 10 is arranged intermediate the first end 21 and the second end 22. The liquid ejection nozzle 112 typically has the form of a unitary body were the second liquid outlet 10 has the form of an opening in (or is arranged on) the side 23 of the liquid ejection nozzle 112.

The liquid ejection nozzle 112 is in one embodiment arranged on the rotary hub 110 such that the second liquid outlet 10 faces away from the pipe 101 at all times when the rotary hub 110 rotates in the second direction R2 about the second geometrical axis A2.

The liquid ejection nozzle 112 comprises, as seen in a direction from the first end 21 to the second end 22, a circular connection section 6, an annular groove 7, a first cylindrical section 8, a second cylindrical section 9 that is tapered in a direction towards the second end 22, and a third cylindrical section 12 that is tapered in a direction towards the second end 22. It may also be said that each of the cylindrical sections 9 and 12 have the shape of a respective truncated cone. The third cylindrical section 12 is more tapered in the direction towards the second end 22 than the second cylindrical section 9 is.

At a location where the first cylindrical section 8 connects to the second cylindrical section 9 a planar cut-out 24 is located for allowing a tool, such as an adjustable spanner, to engage the liquid ejection nozzle 112. The circular connection section 6 and the annular groove 7 facilitates the connection of the liquid ejection nozzle 112 to the rotary hub 110. In principle, the connection of the liquid ejection nozzle 112 to the rotary hub 110 may be accomplished according to any conventional technique within the field of tank cleaning and mixing apparatuses.

The liquid ejection nozzle 112 has a hollow, longitudinal passage that extends from the first end 21 to the second end 22, i.e. the longitudinal passage extends from the liquid inlet 4 to the first liquid outlet 5. The longitudinal passage comprises, in a direction from the first end 21 to the second end 22, an annular bevel 19, a first cylindrical passage 17, a second cylindrical passage 16 that is tapered in a direction towards the second end 22, a third cylindrical passage 15 that is tapered in a direction towards the second end 22, a fourth cylindrical passage 14 that is tapered in a direction towards the second end 22, a fifth cylindrical passage 13 that is tapered in a direction towards the second end 22, and an annular groove 20. It may also be said that each of the tapered, cylindrical passages 16, 15, 14 and 13 have the shape of a respective truncated cone, and that a top of a previous passage of these passages 16, 15, 14 and 13 forms a base of a next passage of these passages 15, 14 and 13. The second passage 16 and the fourth passage 14 is more tapered in the direction towards the second end 22 than the third passage 15. The fifth passage 13 is less tapered than the fourth passage 14, as seen in the direction towards the second end 22.

A number of pipes 18 are inserted into the first passage 17 for ensuring a more linear flow of liquid through the liquid ejection nozzle 112. Typically, five or more pipes are inserted in the first passage 17. Instead of pipes, inserts with e.g. a star shape, oval shape or rectangular shape that provide a more linear flow of liquid may be used.

Figure 9:
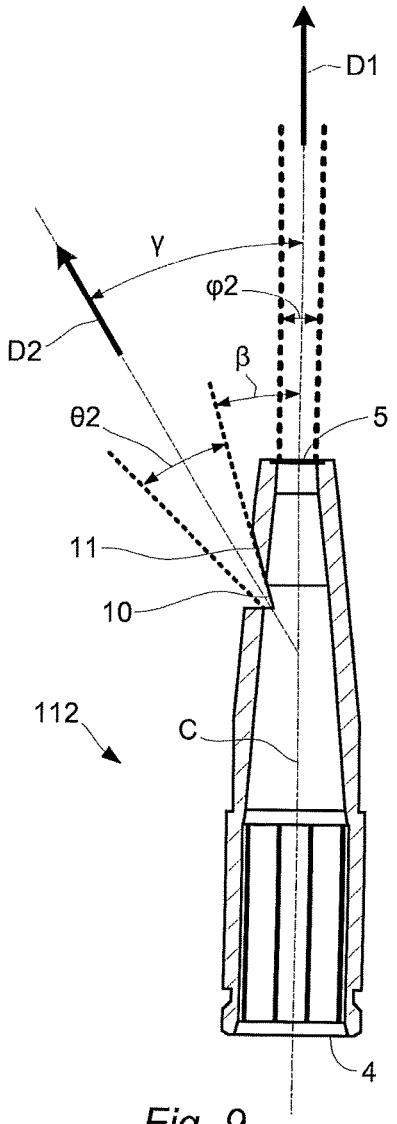
FIG. 9 is a view corresponding to that of FIG. 8, showing liquid divergence from the fluid ejection nozzle.
Figure 10:
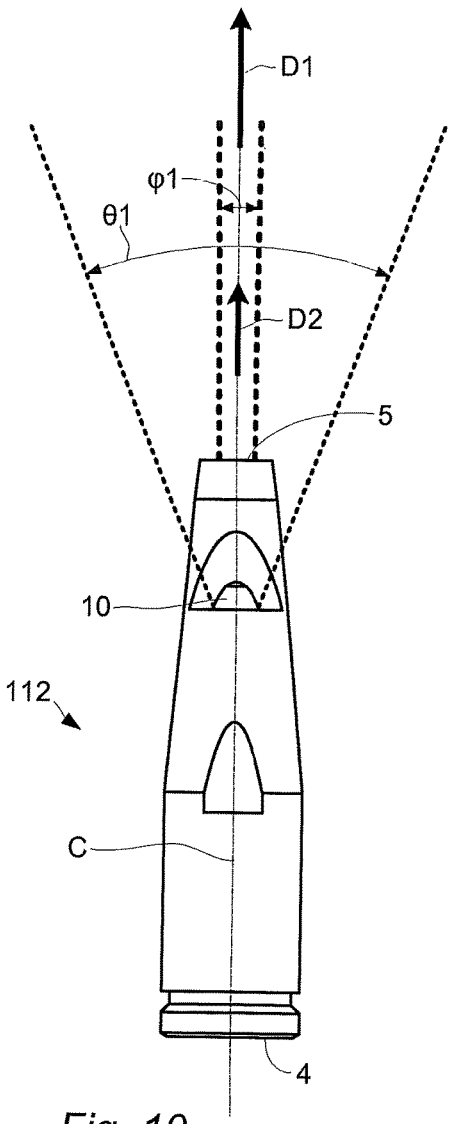
FIG. 10 is a view corresponding to that of FIG. 7, showing liquid divergence from the fluid ejection nozzle.

With further reference to FIGS. 9-10, the liquid ejected by the first liquid outlet 5 is typically ejected in form of a jet beam. The jet beam then diverges by an angle $\psi 1$ of 1° to 5°, as seen in a first geometrical plane that is parallel to the center axis C of the nozzle 112, and diverges by an angle $\varphi 2$ of 1° to 5°, as seen in a second geometrical plane that is parallel to the center axis C of the nozzle 112 and that is perpendicular to the first geometrical plane. The first geometrical plane may be a front plane of the liquid ejection nozzle 112 (corresponding to the view of FIG. 10) and the second geometrical plane may be a side plane of the liquid ejection nozzle 112 (corresponding to the view of FIG. 9). Obviously, the first liquid outlet 5 is configured such that it ejects liquid in form of a jet beam that diverges by the mentioned angles $\varphi 1$ and $\varphi 2$.

As mentioned, the liquid ejected by the second liquid outlet 10 may be ejected in form of a spray beam. Then the spray beam may diverge by an angle $\theta 1$ of 20° to 90°, as seen in the first geometrical plane, and may diverge by an angle $\theta 2$ of 1° to 50°, as seen in the second geometrical plane. If the second liquid outlet 10 ejects the liquid in form of a jet beam, then the angle $\theta 1$ may be 0° to 5°, and the angle $\theta 2$ may be 0° to 5°. Obviously, the second liquid outlet 10 is configured such that it ejects liquid in form of a spray beam or jet beam that diverges by the mentioned angles $\theta 1$ and $\theta 2$. The angles $\alpha$ and $\beta$ (see FIG. 8) will influence in particular which value the angle $\theta 2$ will have.

The liquid ejected from the first liquid outlet 5 and from the second liquid outlet 10 have a great impact on how efficient the interior surface 41 of the tank 40 is cleaned and/or how efficient a content of the tank 40 is mixed. For obtaining a result that provides both adequate cleaning and mixing a number of parameters have been optimized.

With reference to FIG. 7, such parameters include a diameter d1 of the first liquid outlet 5, a diameter d2 of the liquid inlet 4, a width d3 of a cut-out that forms the second liquid outlet 10, a width d4 of the second liquid outlet 10, a length d5 of the second liquid outlet 10, and a length d6 of the liquid ejection nozzle 112. In detail, d1 may be 2 to 17 mm, d2 may be 10 to 25 mm, d3 may be 10 to 20 mm, d4 may be 1 to 15 mm, d5 may be 2 to 10 mm and d6 may be 15 to 130 mm. The first liquid outlet 5 and the second liquid outlet 10 are configured, or given a predetermined form, such that the angles $\alpha$, $\beta$, $\gamma$, $\varphi 1$, $\varphi 2$, $\theta 1$ and $\theta 2$ are given predetermined values in degrees. As indicated, a may be 0-50, $\beta$ may be 5-45°, $\gamma$ may be 5-60, $\varphi 1$ may be 0° to 5°, $\varphi 2$ may be 0° to 5°, $\theta 1$ may be 20 to 90 and $\theta 2$ may be 0-50°. Obviously, some conditions applies for the mutual relationships between different values for d1, d2, d3, d4, d5, d6, $\alpha$, $\beta$, $\gamma$, $\varphi 1$, $\varphi 2$, $\theta 1$ and $\theta 2$. For example, $\gamma$ is typically smaller than $\alpha+\beta$, d3 is larger than d4, d1 is smaller than d2. Exactly which such conditions apply is easily established when giving the liquid ejection nozzle 112 its final shape and dimensions.

These values for d1, d2, d3, d4, d5, d6, $\alpha$, $\beta$, $\gamma$, $\varphi 1$, $\varphi 2$, $\theta 1$ and $\theta 2$ are, alone or in any combination, optimized to give a best cleaning and/or mixing result when fluid is fed to the liquid ejection nozzle 112 at a predetermined pressure and at a predetermined flow rate. To accomplish predetermined pressure and flow rate, the liquid ejection apparatus 100 comprises the pump 54, which feeds the fluid into the liquid ejection nozzle 112 at a pressure of 0.5 to 9 bar and at a flow rate of 10 to 250 liters per minute (per nozzle). The pressure and the flow rate in question is the pressure and flow rate at the liquid inlet 4 of the liquid ejection nozzle 112.

Moreover, tests have shown that the values of d1, d2, d3, d4, d5, d6, $\alpha$, $\beta$, $\gamma$, $\varphi 1$, $\varphi$, $\theta 1$ and $\theta 2$ provide, alone or in any combination, good cleaning and mixing results when the drive system 27, 109 (or any other suitable type of drive system) provides a rotation of the rotary head 106 in the first direction R1 at a rotational speed of 0.2 to 6 rpm, and a rotation of the rotary hub 110 in the second direction R2 at a rotational speed of 0.2 to 10 rpm.

Turning back to FIG. 1 the liquid ejection apparatus 100 has two liquid ejection nozzles 112, 113 of which the first 112 has been described in connection with FIGS. 5-10. The first liquid ejection nozzle 112 has the second liquid outlet 10 arranged on a side 23 of the liquid ejection nozzle 112 that faces away from the fluid line 101 at all times when the rotary hub 110 rotates in the second direction R2 about the second geometrical axis A2. In principle, the orientation by which the first liquid ejection nozzle 112 is attached to the rotary hub 110 determines which direction the second liquid outlet 10 faces.

Figure 11:
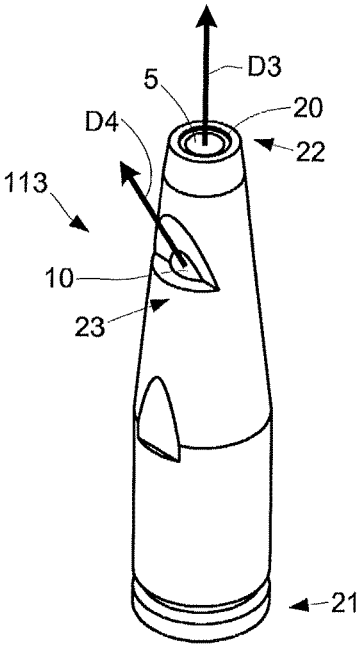
FIG. 11 is a perspective view of a second fluid ejection nozzle of the liquid ejection apparatus of FIG. 1.

With further reference to FIG. 11 the second liquid ejection nozzle 113 on the hub is similar to the liquid ejection nozzle 112 and share the same reference numerals for the same features. The second liquid ejection nozzle 113 comprises a first liquid outlet 5 capable of ejecting the liquid in a third direction D3 towards the interior surface 41 of the tank 40, and a second liquid outlet 10 capable of ejecting the liquid in a fourth direction D4 towards the interior surface 41 of the tank 40. The second liquid ejection nozzle 113 has the second liquid outlet 10 arranged on a side 23 of the liquid ejection nozzle 113 that faces the fluid line 101 during a period of time when the rotary hub 110 rotates in the second direction R2 about the second geometrical axis A2. In one embodiment the second liquid ejection nozzle 113 is identical to the first liquid ejection nozzle 112. However, the second liquid ejection nozzle 113 is attached to the rotary hub with its second liquid outlet 10 facing in an opposite direction than the second liquid outlet 10 of the first liquid ejection nozzle 112. Thus, the second outlet of the second liquid ejection nozzle 113 is then arranged on a side of the second liquid ejection nozzle 113 that faces another direction than the second liquid outlet 10 of the first liquid ejection nozzle 112.

That the liquid outlets of the nozzles 112, 113 are capable of ejecting liquid towards the interior surfaces of the tank does not exclude that the nozzles are capable of ejecting liquid towards other parts and components. For example, the nozzles 112, 113 may eject liquid towards various components of the liquid ejection apparatus 100 or towards other types of equipment in the tank 40. In the illustrated embodiment, the first liquid ejection nozzle 112 ejects liquid from the second liquid outlet 10 towards the pipe 101 during a period of each rotation of the rotary hub 110.

The liquid ejection system 100 may be mounted in an opening in any wall portion of the tank to be cleaned, and the pipe may thus extend into the tank in any desired direction.

The liquid ejection nozzle 112 may have more than the illustrated two liquid outlets 5, 10, such as three, four or five liquid outlets. It is also possible to give the second liquid ejection nozzle 113 another shape and/or another number of liquid outlets than the first liquid ejection nozzle 112. For an embodiment where the liquid ejection apparatus 100 has four nozzles, two nozzles may be arranged like the nozzles 112, and 113, while the other two nozzles may be arranged in a similar way, i.e. with one nozzle having a second outlet facing the fluid line 101 while the second outlet of the other nozzle faces away from the fluid line 101 (during a period of rotation around the second axis A2). Of course, the nozzles may be arranged with their second outlets facing other directions.

Figure 12:
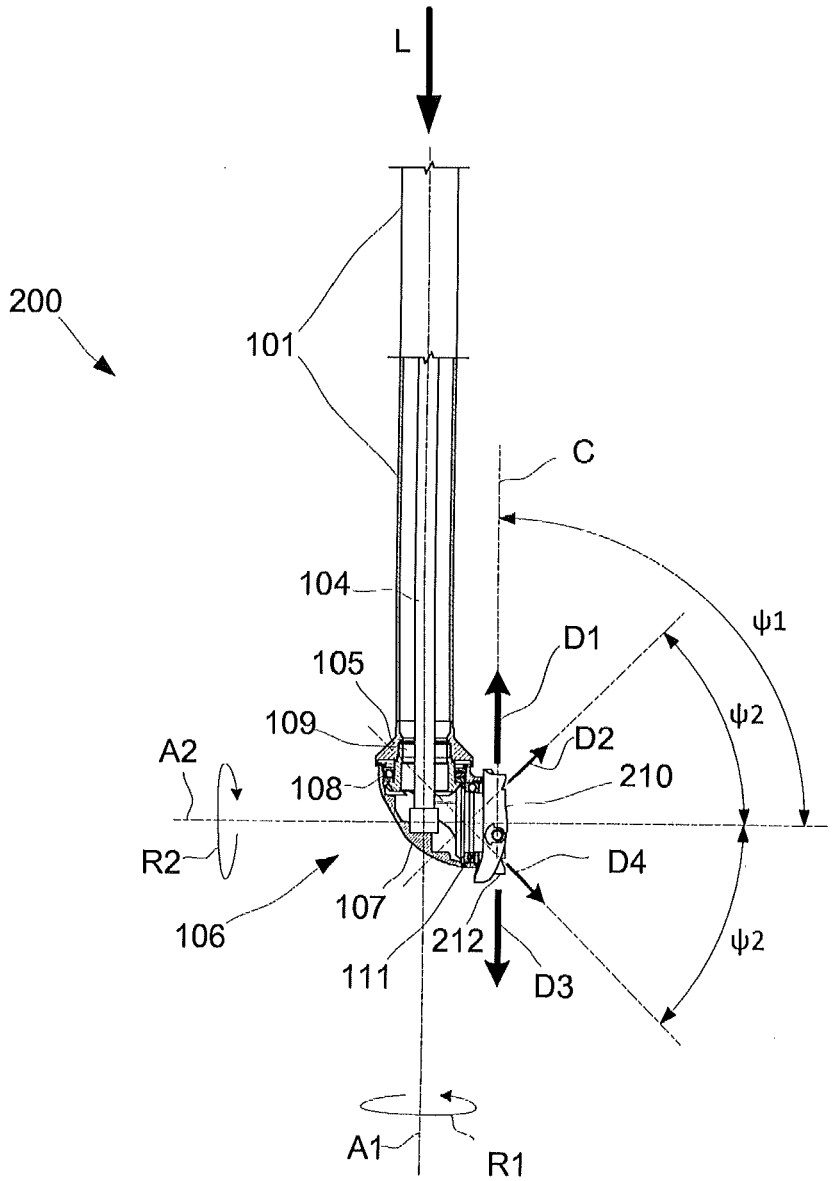
FIG. 12 is a schematic view of a liquid ejection apparatus according to a second embodiment.

With reference to FIG. 12 another embodiment of a liquid ejection apparatus 200 is illustrated, This apparatus 200 is similar with the apparatus 100 of FIG. 1 but for a different rotary hub 210 and different liquid ejection nozzles 212. In other aspects the apparatuses 100 and 200 share the same components and functionality, including the rotation in the first direction R1 about the first geometrical axis A1 and the rotation in the second direction R2 about the second geometrical axis A2. The apparatus 200 of FIG. 12 may made different from the apparatus 100 of FIG. 1, for example by implementing the features shown in patent document WO9204994A1. In other words, the rotary hub 210 and its liquid ejection nozzles may implement all relevant features shown in patent document WO9204994A1.

With further reference to FIGS. 13-15 the rotary hub 210 has a first liquid ejection nozzle 212, a second liquid ejection nozzle 213, a third liquid ejection nozzle 214 and a fourth liquid ejection nozzle 215. One, two or three of the nozzles 212-215 may be omitted. The nozzles are typically similar and are symmetrically arranged on the rotary hub 210.

Turning back to FIG. 12 and using the first liquid ejection nozzle 212 as an exemplifying nozzle, it comprises a first liquid outlet 5 that is arranged to eject liquid in a first direction D1 towards an interior surface of a tank and a second liquid outlet 10 that is arranged to eject liquid in a second direction D2 towards the interior surface of the tank 40. The second direction D2 is inclined to the second geometrical axis A2 by an angle ψ2 of 10°-80°. The second direction D2 may be inclined to the second geometrical axis A2 by an angle ψ2 of 20°-70°.

As may be seen from the figures, the second direction D2 is directed away from the first geometrical axis A1 at all times during a rotation of the rotary hub 210 about the second geometrical axis A2. It may also be seen that the second direction D2 is inclined to the first geometrical axis A1 at all times during a rotation of the rotary hub 210 about the second geometrical axis A2. The first direction D1 is typically inclined to the second geometrical axis A2 by an angle ψ1 of 80°-100°. The first direction D1 may be inclined to the second geometrical axis A2 by an angle ψ1 of 90°. To accomplish the second direction D2 and the angle ψ2 the second liquid outlet 10 may comprise surfaces corresponding to surfaces 10 and 25 (see FIG. 8).

Turning back to FIG. 15 and with further reference to FIG. 16, the nozzle 212 has a first long side 217 that is recessed into or integrated with the rotary hub 210 and a second long side 218 that comprises the second liquid outlet 10. The second long side 218 is opposite the first long side 217. At one end of the long sides 217, 218 the nozzle has the first liquid outlet 5 and at the other end of the long sides 217, 218 it has a liquid inlet 4. The second fluid outlet 10 is arranged between the liquid inlet 4 and the first liquid outlet 5. The liquid enters the liquid inlet 4 from a liquid channel (not shown) at a back side of the rotary hub 210. All liquid inlets of all nozzles receive liquid from this channel and the channel receives liquid from the housing 107 (see FIG. 12) on which the rotary hub 210 is arranged.

The nozzle 212 is, as seen from a front side 211 of the rotary hub 210, arranged within a radial periphery 216 of the rotary hub 210. This means that the nozzle 212 does not extend outside the periphery 216, as seen in a radial direction where the second geometrical axis A2 comprises the radial center. All nozzles 212-215 are arranged within the radial periphery 216 of the rotary hub 210.

From the description above follows that, although various embodiments of the invention have been described and shown, the invention is not restricted thereto, but may also be embodied in other ways within the scope of the subject-matter defined in the following claims.

The invention claimed is:

1. A liquid ejection apparatus comprising a fluid line which extends into a tank and receives liquid during operation, a rotary head being arranged on the fluid line and fitted with a rotary hub that comprises first and second liquid ejection nozzles for ejecting the liquid, the rotary head rotating during operation in a first direction about a first geometrical axis and the rotary hub rotating during operation in a second direction about a second geometrical axis that is offset from the first geometrical axis, such that the liquid ejected by the first and second liquid ejection nozzles is ejected in a pattern towards an interior surface of the tank, wherein each of the liquid ejection nozzles comprises a first liquid outlet arranged to eject the liquid in a first direction towards the interior surface of the tank, a second liquid outlet arranged to eject the liquid in a second direction towards the interior surface of the tank, which second direction is inclined to the second geometrical axis by an angle of 10° to 80°, and the second liquid outlet of the first liquid ejection nozzle being oriented so that the second direction in which the liquid is ejected from the second liquid outlet of the first liquid ejection nozzle is directed away from the fluid line and toward the interior surface of the tank at all times during rotation of the rotary hub about the second geometrical axis.

2. A liquid ejection apparatus according to claim 1, wherein the second liquid outlet of the second liquid ejection nozzle is oriented so that the second direction in which the liquid is ejected from the second liquid outlet of the second liquid ejection nozzle is directed away from the fluid line and toward the interior surface of the tank at all times during rotation of the rotary hub about the second geometrical axis.

3. A liquid ejection apparatus according to claim 1, wherein the second direction is inclined to the first geometrical axis at all times during a rotation of the rotary hub about the second geometrical axis.

4. A liquid ejection apparatus according to claim 1, wherein the first direction is inclined to the second geometrical axis by an angle of 80° to 100°.

5. A liquid ejection apparatus according to claim 1, wherein the second axis is inclined to the first axis by an angle of 80° to 100°.

6. A liquid ejection apparatus according to claim 1, wherein the first direction lies in a plane that is perpendicular to the second geometrical axis, the first direction being offset from the second direction by an angle of 5° to 60°.

7. A liquid ejection apparatus according to claim 1, wherein a liquid inlet is arranged at a first end of each of the liquid ejection nozzles, the first liquid outlet is arranged at a second end of the respective liquid ejection nozzle, the second end being opposite the first end, and the second liquid outlet is arranged at a side of the respective liquid ejection nozzle.

8. A liquid ejection apparatus according to claim 1, wherein each of the liquid ejection nozzles forms a unitary body, and the second liquid outlet has the form of an opening in a side of the respective liquid ejection nozzle.

9. A liquid ejection apparatus according to claim 1, wherein the second liquid outlet comprises a surface that is inclined by an angle of 5° to 45° in relation to a center axis of the respective liquid ejection nozzle, for directing liquid ejected from the second liquid outlet.

10. A liquid ejection apparatus according to claim 1, wherein the second liquid outlet is configured to eject liquid from the second liquid outlet during mixing of the liquid in the tank or during cleaning of the tank such that the liquid diverges by an angle of 20° to 90°, as seen in a first geometrical plane that is parallel to a center axis of the respective nozzle.

11. A liquid ejection apparatus according to claim 10, wherein the second liquid outlet is configured to eject liquid from the second liquid outlet during mixing of the liquid in the tank or during cleaning of the tank such that the liquid ejected from the second liquid outlet diverges by an angle of 1° to 50°, as seen in a second geometrical plane that is parallel to the center axis of the respective nozzle and perpendicular to the first geometrical plane.

12. A liquid ejection apparatus according to claim 1, wherein the second liquid outlet has a width of at least 3 mm.

13. A liquid ejection apparatus according to claim 1, comprising a drive system that provides a rotation of the rotary head in the first direction at a rotational speed of 0.2 to 6 rpm, and a rotation of the rotary hub in the second direction at a rotational speed of 0.2 to 10 rpm.

14. A liquid ejection apparatus according to claim 1, wherein a first long side of each of the nozzles is recessed into the rotary hub and a second long side of each of the nozzles comprises the second liquid outlet.

15. A liquid ejection apparatus according to claim 1, wherein each of the nozzles is, as seen from a front side of the rotary hub, arranged within a radial periphery of the rotary hub.

16. A liquid ejection apparatus comprising a fluid line which extends into a tank and receives liquid during operation, a rotary head being arranged on the fluid line and fitted with a rotary hub that comprises a liquid ejection nozzle for ejecting the liquid, the rotary head rotating during operation in a first direction about a first geometrical axis and the rotary hub rotating during operation in a second direction about a second geometrical axis that is offset from the first geometrical axis, such that the liquid ejected by the nozzle is ejected in a pattern towards an interior surface of the tank, the liquid ejection nozzle which is rotatable about the second geometrical axis comprising a first liquid outlet arranged to eject the liquid in a first direction towards the interior surface of the tank, a second liquid outlet arranged to eject the liquid in a second direction towards the interior surface of the tank, the second direction being inclined to the second geometrical axis by an angle of 10° to 80°;

the first and second liquid outlets possessing a cross-sectional area and shape, the shape of the first liquid outlet being different from the shape of the second liquid outlet so that the first liquid outlet ejects the liquid in a form different from the form of the liquid ejected by the second liquid outlet, one of the first and second liquid outlets possessing a circular shape and the other of the first and second liquid outlets possessing an elongated shape; and wherein the cross-sectional area and shape of the first liquid outlet is configured to eject the liquid in the form of a first beam during mixing of the liquid in the tank or during cleaning of the tank, and wherein the cross-sectional area and shape of the second liquid outlet is configured to eject the liquid in the form of a second beam during mixing of the liquid in the tank or during cleaning of the tank, the first and second beams each diverging by a divergence angle, the divergence angle of the first beam being different from the divergence angle of the second beam.

17. A liquid ejection apparatus comprising a fluid line which extends into a tank and receives liquid during operation, a rotary head being arranged on the fluid line and fitted with a rotary hub that comprises a liquid ejection nozzle for ejecting the liquid, the rotary head rotating during operation in a first direction about a first geometrical axis and the rotary hub rotating during operation in a second direction about a second geometrical axis that is offset from the first geometrical axis, such that the liquid ejected by the nozzle is ejected in a pattern towards an interior surface of the tank, the liquid ejection nozzle being a unitary body that comprises both a first liquid outlet arranged to eject the liquid in a first direction towards the interior surface of the tank, a second liquid outlet arranged to eject the liquid in a second direction towards the interior surface of the tank, the second direction being inclined to the second geometrical axis by an angle of 10° to 80°;

the liquid ejection nozzle possessing an elongated shape that extends from a first end of the liquid ejection nozzle to a second end of the liquid ejection nozzle, the first liquid outlet being located at the first end of the liquid ejection nozzle, the second end of the liquid ejection nozzle being a connection section that is connected to the rotary hub so that the liquid ejection nozzle protrudes from the rotary hub;

the liquid ejection nozzle possessing an outer periphery, the second liquid outlet opening to the outer periphery of the liquid ejection nozzle and being located between the first and second ends of the liquid ejection nozzle;

the first liquid outlet being configured to eject the liquid in a beam that diverges by a first angle in a first divergence angle range as seen in a first geometrical plane;

the second liquid outlet being configured to eject the liquid in a beam that diverges by a second angle in a second divergence angle range as seen in a second geometrical plane which is perpendicular to the first geometrical plane; and the first divergence angle range being different from the second divergence angle range.

18. A liquid ejection apparatus according to claim 17, wherein the first and second liquid outlets possess a cross-sectional area and shape, the cross-sectional area of the first liquid outlet being different from the cross-sectional area of the second liquid outlet and/or the shape of the first liquid outlet being different from the shape of the second liquid outlet so that the first liquid outlet ejects the liquid in a form different from the form of the liquid ejected by the second liquid outlet.

19. A liquid ejection apparatus comprising a fluid line which extends into a tank and receives liquid during operation, a rotary head being arranged on the fluid line and fitted with a rotary hub that comprises a liquid ejection nozzle for ejecting the liquid, the rotary head rotating during operation in a first direction about a first geometrical axis and the rotary hub rotating during operation in a second direction about a second geometrical axis that is offset from the first geometrical axis, such that the liquid ejected by the nozzle is ejected in a pattern towards an interior surface of the tank, wherein the liquid ejection nozzle comprises a first liquid outlet arranged to eject the liquid in a first direction towards the interior surface of the tank, a second liquid outlet arranged to eject the liquid in a second direction towards the interior surface of the tank, which second direction is inclined to the second geometrical axis by an angle of 10° to 80°, and the nozzle possessing a center axis and an outer periphery, the second liquid outlet comprising a first surface that opens to the outer periphery of the nozzle and that is inclined by a first angle relative to the center axis of the nozzle, the second liquid outlet also comprising a second surface that opens to the outer periphery of the nozzle and that is inclined by a second angle relative to the center axis of the nozzle, the first angle being different from the second angle.

20. A liquid ejection apparatus according to claim 19, wherein the center axis of the nozzle is parallel to the first geometrical axis.

21. A liquid ejection apparatus comprising a fluid line which extends into a tank and receives liquid during operation, a rotary head being arranged on the fluid line and fitted with a rotary hub that comprises a liquid ejection nozzle for ejecting the liquid, the rotary head rotating during operation in a first direction about a first geometrical axis and the rotary hub rotating during operation in a second direction about a second geometrical axis that is offset from the first geometrical axis, such that the liquid ejected by the nozzle is ejected in a pattern towards an interior surface of the tank, the liquid ejection nozzle being a unitary body that comprises both a first liquid outlet arranged to eject the liquid in a first direction towards the interior surface of the tank, a second liquid outlet arranged to eject the liquid in a second direction towards the interior surface of the tank, the second direction being inclined to the second geometrical axis by an angle of 10° to 80°;

the first liquid outlet being configured to eject the liquid in a beam that diverges by a first angle in a first divergence angle range as seen in a first geometrical plane;

the second liquid outlet being configured to eject the liquid in a beam that diverges by a second angle in a second divergence angle range as seen in a second geometrical plane which is perpendicular to the first geometrical plane; and the first divergence angle range being different from the second divergence angle range.

* * * * *